US008724433B1

(12) United States Patent
Buc

(10) Patent No.: US 8,724,433 B1
(45) Date of Patent: May 13, 2014

(54) TIMED VIBRATING SYSTEM FOR REMINDERS AND HABIT PROGRAMMING

(76) Inventor: Jim Buc, Corona Del Mar, CA (US)

( * ) Notice: Subject to any disclaimer, the term of this patent is extended or adjusted under 35 U.S.C. 154(b) by 376 days.

(21) Appl. No.: 13/223,965

(22) Filed: Sep. 1, 2011

Related U.S. Application Data

(60) Provisional application No. 61/402,660, filed on Sep. 2, 2010.

(51) Int. Cl.
*G04F 1/00* (2006.01)

(52) U.S. Cl.
USPC ..... 368/230

(58) Field of Classification Search
USPC ..... 368/230; 340/407.1
See application file for complete search history.

(56) References Cited

U.S. PATENT DOCUMENTS

| | | | | |
|---|---|---|---|---|
| 5,719,780 | A * | 2/1998 | Holmes et al. | 700/231 |
| 5,788,060 | A * | 8/1998 | Kuroda | 200/343 |
| 5,908,301 | A * | 6/1999 | Lutz | 434/236 |
| 6,558,165 | B1 * | 5/2003 | Curry et al. | 434/236 |
| 6,595,779 | B1 * | 7/2003 | Rose | 434/236 |
| 6,598,563 | B2 * | 7/2003 | Kim et al. | 119/720 |

* cited by examiner

*Primary Examiner* — Amy Cohen Johnson
*Assistant Examiner* — Jason Collins

(57) ABSTRACT

A timed vibrating system for habit programming featuring a microprocessor, a vibrator, and a battery. A switch allows a user to control whether or not the vibration of the vibrator is audible. A cap on the housing allows a user to control the frequency with which the vibrator vibrates. Each vibration, or alert, reminds the user to clear his thoughts and rid his mind of worry so that he can maintain a positive outlook on his disease. The system can be worn on the user's body, for example around his neck on in his pocket.

7 Claims, 4 Drawing Sheets

TIMED VIBRATING SYSTEM FOR REMINDERS AND HABIT PROGRAMMING

CROSS-REFERENCE

This application claims priority to U.S. provisional application Ser. No. 61/402,660 filed Sep. 2, 2010, the specification of which is incorporated herein by reference in its entirety.

FIELD OF THE INVENTION

The present invention is directed to a vibrating device that can be set to vibrate at various pre-programmed times.

BACKGROUND OF THE INVENTION

Diseases, such as cancer, are difficult for individuals to overcome. Many individuals find themselves wrought with worry (or anxiety, stress, fear) that their treatments will not succeed and that they will die. This state of worry (or anxiety, stress, fear) may prevent such individuals from successfully battling their disease. The present invention features a timed vibrating system for habit programming or reminders. The device can be worn on a user's body (e.g., around the neck, for example) and will vibrate at predetermined intervals to help a user train his/her thoughts and habits. For example, the user is reminded at various intervals to clear his/her thoughts, rid him/herself of worry, etc. The system of the present invention can help a user maintain a positive outlook on his/her disease.

The present invention is not limited to diseases such as cancer. For example, in some embodiments, the system is used for individuals with attention deficit disorder (ADD), anxiety, addiction, psychiatric conditions, lack of motivation. In some embodiments, the system is used to promote productivity. In some embodiments, the system is used for meditation.

SUMMARY

The present invention features a timed vibrating system. In some embodiments, the system comprises a housing having an inner cavity; a vibrator and a battery each disposed in the inner cavity of the housing and each attached to a printed circuit board (PCB), the vibrator is adapted to provide a vibration for a predetermined amount of time, the vibrator can move between a first position wherein the vibrator is pressed against the PCB and a second position wherein the vibrator is loosely attached to the PCB, when the vibrator is in the first position vibrations of the vibrator are not audible and when the vibrator is in the second position vibrations of the vibrator are audible, the vibrator is adapted to vibrate at any of a first time interval, a second time interval, a third time interval, or a fourth time interval; a switch disposed on the housing, the switch can move between a first position and a second position, when the switch is in the first position the vibrator is moved to the first position and when the switch is in the second position the vibrator is moved to the second position; a microprocessor operatively connected to each the vibrator and the battery; and a cap disposed on the housing, the cap can move between an on position and an off position; and a spring connected to the cap, the spring is adapted to move between an on position when the cap 160 is in the on position and an off position when the cap is in the off position, when the spring 170 is in the on position the spring operatively connects the battery to the PCB (e.g., a metal contact on the PCB); wherein manipulation of the cap between the on and off position effectively cycles between the first time interval, the second time interval, the third time interval, and the fourth time interval.

In some embodiments, the predetermined amount of time is about 0.5 seconds, about one second, about 2 seconds, about 3 seconds, about 4 seconds, about 5 seconds, about 6 seconds, about 7 seconds, about 8 seconds, about 9 seconds, about 10 seconds, about 15 seconds, about 20 seconds, or about 30 seconds.

In some embodiments, the first time interval is about 5 seconds, about 10 seconds, about 20 seconds, about 30 seconds 4 about 5 seconds, about one minute, about two minutes, about 5 minutes, about 10 minutes, about 20 minutes, about 30 minutes, about 1 hour, about 2 hours, about 3 hours, about 4 hours, about 5 hours, about 6 hours, about 7 hours, about 8 hours, about 9 hours, about 10 hours, about 11 hours, or about 12 hours. In some embodiments, the second time interval is about 5 seconds, about 10 seconds, about 20 seconds, about 30 seconds 4 about 5 seconds, about one minute, about two minutes, about 5 minutes, about 10 minutes, about 20 minutes, about 30 minutes, about 1 hour, about 2 hours, about 3 hours, about 4 hours, about 5 hours, about 6 hours, about 7 hours, about 8 hours, about 9 hours, about 10 hours, about 11 hours, or about 12 hours. In some embodiments, the third time interval is about 5 seconds, about 10 seconds, about 20 seconds, about 30 seconds 4 about 5 seconds, about one minute, about two minutes, about 5 minutes, about 10 minutes, about 20 minutes, about 30 minutes, about 1 hour, about 2 hours, about 3 hours, about 4 hours, about 5 hours, about 6 hours, about 7 hours, about 8 hours, about 9 hours, about 10 hours, about 11 hours, or about 12 hours. In some embodiments, the fourth time interval is about 5 seconds, about 10 seconds, about 20 seconds, about 30 seconds 4 about 5 seconds, about one minute, about two minutes, about 5 minutes, about 10 minutes, about 20 minutes, about 30 minutes, about 1 hour, about 2 hours, about 3 hours, about 4 hours, about 5 hours, about 6 hours, about 7 hours, about 8 hours, about 9 hours, about 10 hours, about 11 hours, or about 12 hours.

In some embodiments, the system further comprises a ring component disposed on the housing.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1A:
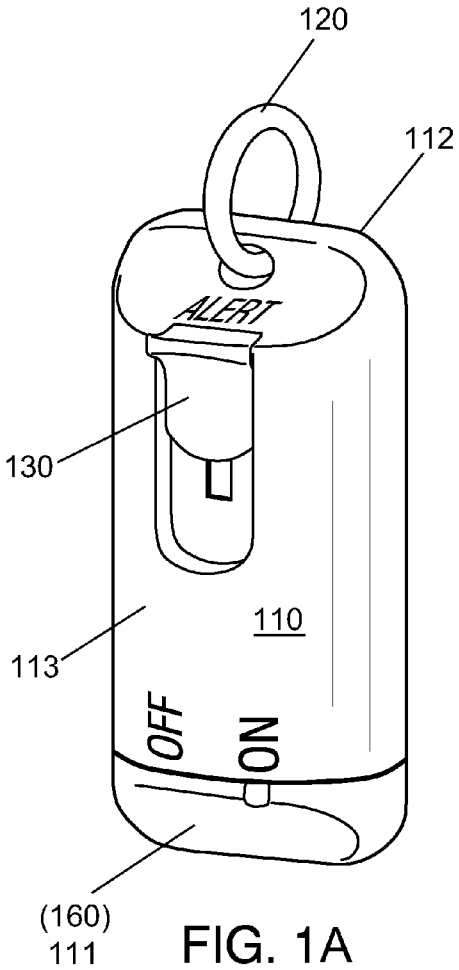
FIG. 1A is a front view of the system of the present invention.
Figure 1B:
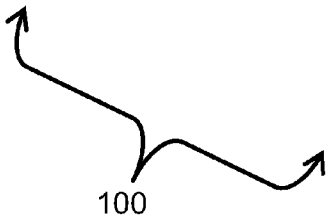
FIG. 1B is a front view of the system of the present invention.
Figure 1B:
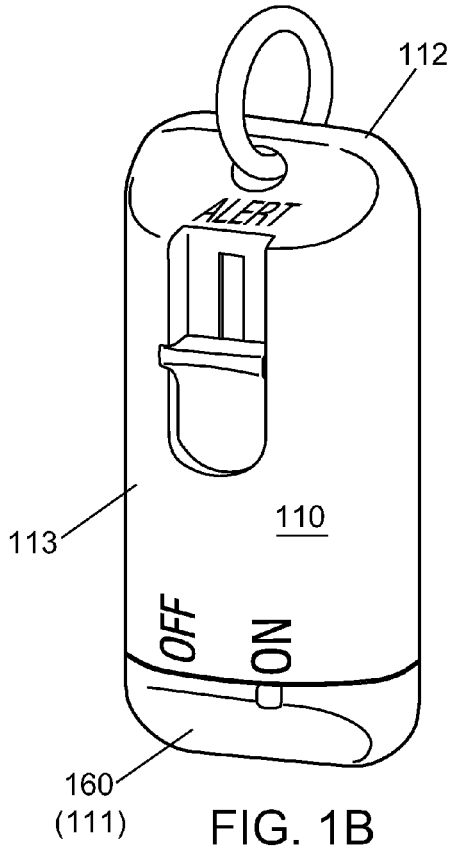
Figure 2:
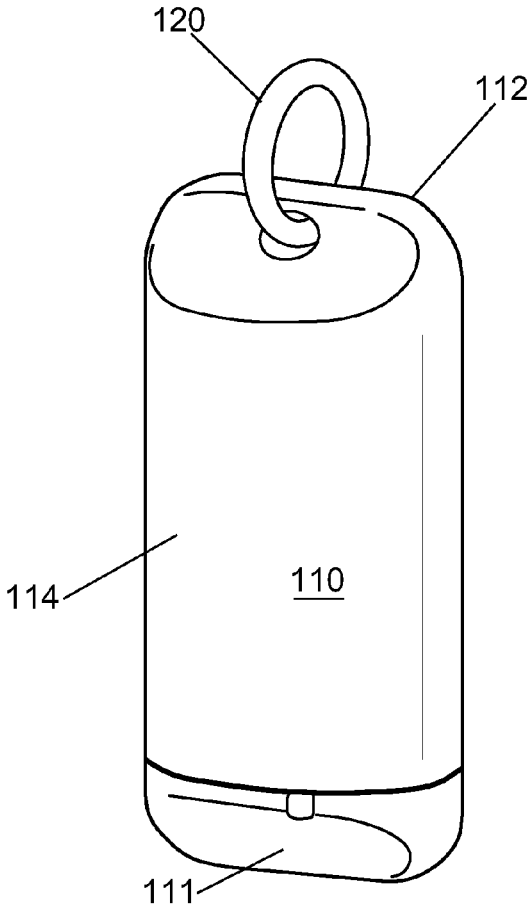
FIG. 2 is a back view of the system of the present invention.

Referring now to FIG. 1-4, the present invention features a timed vibrating system 100 for habit programming or reminders. The system 100 comprises a housing 110 having an inner cavity. In some embodiments, the housing 110 has a first end 111 (e.g., a bottom end), a second end 112 (e.g., a top end), a front surface 113, and a back surface 114 that together form the inner cavity. In some embodiments, a ring component 120 is disposed on the housing 110, for example at or near the second end 112 as shown in FIG. 1 and FIG. 2.

Disposed in the inner cavity is a printed circuit board (PCB) 210. The system 100 further comprises at least one battery 220 and a vibrator 230 (for providing vibrations). The system 100 further comprises a microprocessor 250 operatively connected to the battery 220 and the vibrator 230. The system 100 further comprises resistors and capacitors, which are well known to one of ordinary skill in the art.

The vibrator 230 is programmed to vibrate at a first time interval. At each vibration of the vibrator 230, the user can notice and cease negative thoughts, and modify his/her thoughts based on his/her condition or need. In some embodiments, the system 100 features two time intervals (e.g., a first time interval and a second time interval) between which the user can choose. In some embodiments, the system 100 features three intervals (e.g., a first time interval, a second time interval, and a third time interval) between which the user can choose. In some embodiments, the system 100 features four time intervals (e.g., a first time interval, a second time interval, a third time interval, and a fourth time interval) between which the user can choose. In some embodiments, the system 100 features more than four time intervals between which the user can choose. The user can change the time interval by manipulating the cap 160 as described below. The first time interval is less than the second time interval. The second time interval is less than the third time interval. The third time interval is less than the fourth time interval.

In some embodiments, the first time interval and/or the second time interval and/or the third time interval and/or the fourth time interval is about 5 seconds, about 10 seconds, about 20 seconds, about 30 seconds 4 about 5 seconds, about one minute, about two minutes, about 5 minutes, about 10 minutes, about 20 minutes, about 30 minutes, about 1 hour, about 2 hours, about 3 hours, about 4 hours, about 5 hours, about 6 hours, about 7 hours, about 8 hours, about 9 hours, about 10 hours, about 11 hours, or about 12 hours. The time intervals are not limited to the aforementioned time intervals.

A switch 130 is disposed on the housing 110, for example the front surface 113 of the housing 110. The switch 130 can move between a first position and a second position. When the switch 130 is in the first position, the vibration of the vibrator 230 is audible. When the switch 130 is moved to the second position, the vibration of the vibrator 230 is silent. This allows a user to silence the system 100 when sound may be inappropriate.

The vibrator 230 is loosely attached to the PCB 210 when the switch 130 is in the second position. When the vibrator 230 vibrates, it rattles within the inner cavity of the housing 110; thus vibrations of the vibrator 230 in this position are audible. When the switch 130 is moved to the first position, the vibrator 230 is pressed to the PCB 210 (and thus is silenced).

Figure 3:
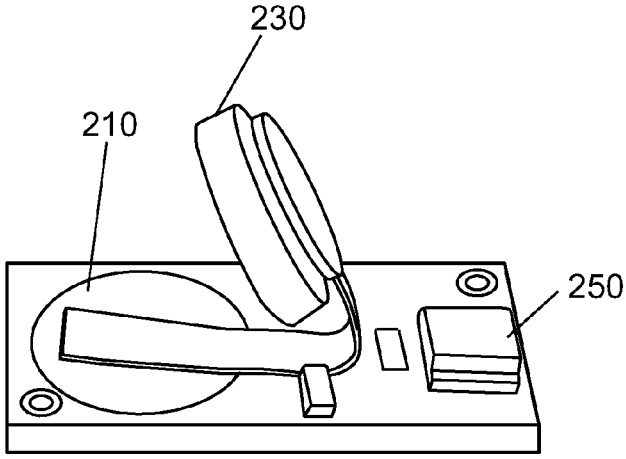
FIG. 3 is a perspective view of the electrical components of the system of the present invention.
Figure 3A:
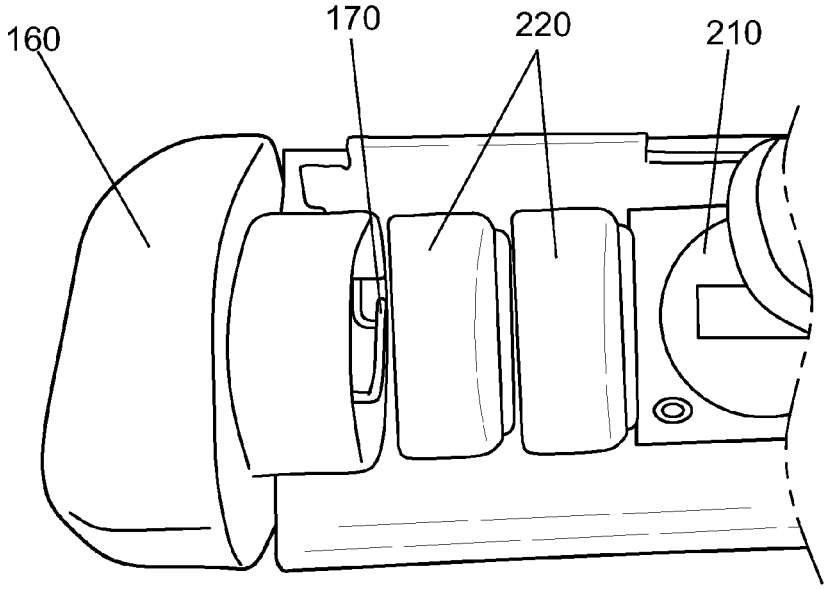
FIG. 3A is a perspective view of the cap, spring, and battery of the system of the present invention.
Figure 4:
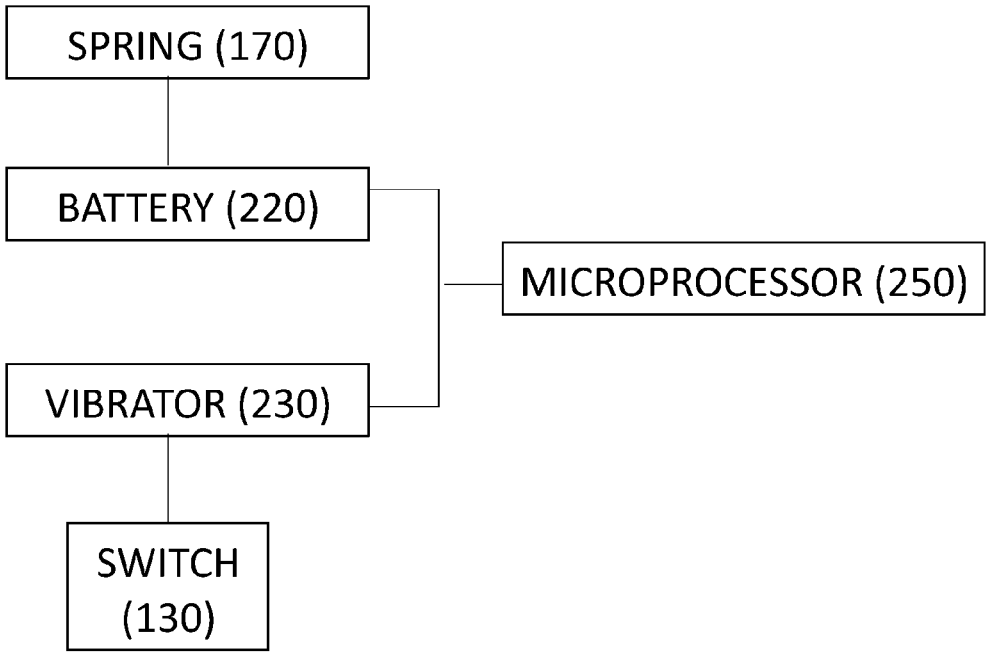
FIG. 4 is a schematic view of the electrical components of the system of the present invention.

A cap 160 is disposed on the housing 110, for example on the first end 111 of the housing 110. The cap 160 can move between an on position and an off position. As shown in FIG. 3A, a spring 170 is disposed in the inner cavity of the housing 110 and is connected to the cap 160. The spring 170 is functions to operatively connect the battery 220 to a metal contact on the PCB. The spring 170 can move between at least an on position when the cap 160 is in the on position and an off position when the cap is in the off position. When the spring 170 is in the on position the spring 170 operatively connects the battery 220 to the PCB 210.

When the cap 160 is rapidly moved between the on and off positions, the time interval of the vibration is changed from the first time interval to the second time interval, from the second time interval to the third time interval, from the third time interval to the fourth time interval, or from the fourth time interval to the first time interval (e.g., from 5 seconds to 20 seconds, from 20 seconds to 1 minute, from 1 minute to 2 minutes, from 2 minutes to 5 seconds, etc.). For example, when the system is powered on (e.g., via the cap 160 moving to the on position) after an interval (e.g., of a couple of seconds), the system reenters the previous alert time interval. A feedback system informs the user of the current time interval by providing a series of vibrations, for example: one short vibration refers to the first time interval (e.g., 5 second interval), two short vibrations refers to the second time interval (e.g., 20 second interval), three short vibrations refers to the third time interval (e.g., 1 minute interval), and four short vibrations refers to the fourth time interval (e.g., 2 minute interval). When the power is turned off but turned back on (e.g., via the cap 160) within a fixed time frame (e.g., 1 second), a capacitor keeps the microprocessor 250 on and changes to the next higher time interval. Feedback is provided by incrementing the number of vibrations till the maximum time is reached and the device cycles to the first interval.

The vibration lasts for a predetermined amount of time. For example, in some embodiments, the vibration lasts about 0.5 seconds, about one second, about 2 seconds, about 3 seconds, about 4 seconds, about 5 seconds, about 6 seconds, about 7 seconds, about 8 seconds, about 9 seconds, about 10 seconds, about 15 seconds, about 20 seconds, about 30 seconds, etc. The present invention is not limited to the aforementioned vibration times.

A user can wear the system 100, carry the system 100 in his/her pocket, hold the system in his/her hand, or set the system 100 in close proximity. In some embodiments, a ring component 120 (e.g., a loop, a hook, etc.) is disposed on the housing 110, for example at the second end 112 of the housing 110, allowing the user to clip the housing 110 to his/her person or wear the housing 110, e.g., like a necklace.

In some embodiments, the system 100 is linked to a website. In some embodiments, the system is linked to a social media system. The website would have training videos for reference. Social media would be used to reinforce training to ensure success.

The system 100 of the present invention may be constructed in a variety of shapes, sizes, styles, and designs. In some embodiments, the housing 110 is between about 1 to 2 inches in length as measured from the first end 111 to the second end 112. In some embodiments, the housing 110 is between about 2 to 3 inches in length as measured from the first end 111 to the second end 112. In some embodiments, the housing 110 is between about 3 to 4 inches in length as measured from the first end 111 to the second end 112. The system 100 is not limited to the aforementioned dimensions.

As used herein, the term "about" refers to plus or minus 10% of the referenced number. For example, an embodiment wherein the housing 110 is about 2 inches in length includes a housing 110 that is between 1.8 and 2.2 inches in length.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A timed vibrating system 100 comprising:

(a) a housing 110 having an inner cavity;

(b) a vibrator 230 and a battery 220 each disposed in the inner cavity of the housing 110 and each attached to a printed circuit board (PCB) 210, the vibrator 230 is adapted to provide a vibration for a predetermined amount of time, the vibrator 230 can move between a first position wherein the vibrator 230 is pressed against the PCB 210 and a second position wherein the vibrator 230 is loosely attached to the PCB 210, when the vibrator 230 is in the first position vibrations of the vibrator 230 are not audible and when the vibrator 230 is in the second position vibrations of the vibrator are audible, the vibrator 230 is adapted to vibrate at any of a first time interval, a second time interval, a third time interval, or a fourth time interval;

(d) a switch 130 disposed on the housing 110, the switch 130 can move between a first position and a second position, when the switch 130 is in the first position the vibrator 230 is moved to the first position and when the switch 130 is in the second position the vibrator is moved to the second position;

(c) a microprocessor 250 operatively connected to each the vibrator 230 and the battery 220; and (d) a cap 160 disposed on the housing 110, the cap 160 can move between an on position and an off position; and (e) a spring 170 connected to the cap 160, the spring 170 is adapted to move between an on position when the cap 160 is in the on position and an off position when the cap is in the off position, when the spring 170 is in the on position the spring 170 operatively connects the battery 220 to the PCB 210;

wherein manipulation of the cap between the on and off position effectively cycles between the first time interval, the second time interval, the third time interval, and the fourth time interval.

2. The system 100 of claim 1, wherein the predetermined amount of time is about 0.5 seconds, about one second, about 2 seconds, about 3 seconds, about 4 seconds, about 5 seconds, about 6 seconds, about 7 seconds, about 8 seconds, about 9 seconds, about 10 seconds, about 15 seconds, about 20 seconds, or about 30 seconds.

3. The system 100 of claim 1, wherein the first time interval is about 5 seconds, about 10 seconds, about 20 seconds, about 30 seconds 4 about 5 seconds, about one minute, about two minutes, about 5 minutes, about 10 minutes, about 20 minutes, about 30 minutes, about 1 hour, about 2 hours, about 3 hours, about 4 hours, about 5 hours, about 6 hours, about 7 hours, about 8 hours, about 9 hours, about 10 hours, about 11 hours, or about 12 hours.

4. The system 100 of claim 1, wherein the second time interval is about 5 seconds, about 10 seconds, about 20 seconds, about 30 seconds 4 about 5 seconds, about one minute, about two minutes, about 5 minutes, about 10 minutes, about 20 minutes, about 30 minutes, about 1 hour, about 2 hours, about 3 hours, about 4 hours, about 5 hours, about 6 hours, about 7 hours, about 8 hours, about 9 hours, about 10 hours, about 11 hours, or about 12 hours.

5. The system 100 of claim 1, wherein the third time interval is about 5 seconds, about 10 seconds, about 20 seconds, about 30 seconds 4 about 5 seconds, about one minute, about two minutes, about 5 minutes, about 10 minutes, about 20 minutes, about 30 minutes, about 1 hour, about 2 hours, about 3 hours, about 4 hours, about 5 hours, about 6 hours, about 7 hours, about 8 hours, about 9 hours, about 10 hours, about 11 hours, or about 12 hours.

6. The system 100 of claim 1, wherein the fourth time interval is about 5 seconds, about 10 seconds, about 20 seconds, about 30 seconds 4 about 5 seconds, about one minute, about two minutes, about 5 minutes, about 10 minutes, about 20 minutes, about 30 minutes, about 1 hour, about 2 hours, about 3 hours, about 4 hours, about 5 hours, about 6 hours, about 7 hours, about 8 hours, about 9 hours, about 10 hours, about 11 hours, or about 12 hours.

7. The system 100 of claim 1 further comprising a ring component 120 disposed on the housing 110.

* * * * *